United States Patent [19]

Gruber

[11] 4,106,425

[45] Aug. 15, 1978

[54] MARINE PROPULSION UNIT WITH PROTECTED SCREW

[75] Inventor: Ludwig Gruber, Freilassing, Fed. Rep. of Germany

[73] Assignee: John GmbH, Freilassing, Fed. Rep. of Germany

[21] Appl. No.: 793,305

[22] Filed: May 3, 1977

[30] Foreign Application Priority Data

May 11, 1976 [DE] Fed. Rep. of Germany ..... 2620770

[51] Int. Cl.[2] ..... B63H 5/14

[52] U.S. Cl. ..... 115/42; 115/18 E

[58] Field of Search ..... 115/6.1, 12 A, 11, 16, 115/17, 18 E, 42; 114/166, 151; 60/221

[56] References Cited

U.S. PATENT DOCUMENTS

| | | | |
|---|---|---|---|
| 2,473,603 | 6/1949 | Miller | 115/16 |
| 2,714,800 | 8/1955 | Gongwer | 60/221 |
| 2,983,246 | 5/1961 | Manley | 115/42 |
| 3,358,635 | 12/1967 | McRee | 115/6.1 |
| 3,389,558 | 6/1968 | Hall | 60/221 |
| 3,802,377 | 4/1974 | Porter et al. | 115/18 E X |

FOREIGN PATENT DOCUMENTS

| | | | |
|---|---|---|---|
| 1,269,000 | 5/1968 | Fed. Rep. of Germany | 115/42 |
| 2,445,324 | 1/1976 | Fed. Rep. of Germany | 115/6.1 |

*Primary Examiner*—Trygve M. Blix
*Assistant Examiner*—Sherman D. Basinger
*Attorney, Agent, or Firm*—Hans Berman

[57] ABSTRACT

The screw of a marine propulsion unit is mounted in a passage of an elongated casing in an axially central position. The two axially terminal portions of the passage contain protective devices for preventing accidental insertion of a limb of a human adult or child to a depth sufficient to reach the rotating screw without preventing flow of water through the terminal passage portions.

11 Claims, 5 Drawing Figures

MARINE PROPULSION UNIT WITH PROTECTED SCREW

This invention relates to marine propulsion units, and particularly to a propulsion unit having a screw which is rotated rapidly enough to injure a swimmer in adjacent water.

It is a primary object of this invention to provide a marine propulsion unit whose screw cannot accidentally touch a human body.

It is another object of this invention to provide protection against injury by the screw of a propulsion unit without impairing the propelling efficiency of the unit.

With these and other objects in view, the invention, in one of its more specific aspects, provides a propulsion unit which includes an elongated casing formed with a passage therethrough which is of substantially circular cross section transverse to a longitudinal axis. A driven propelling screw is mounted in an axially central portion of the passage for rotation in a plane perpendicular to the axis, and protective devices are arranged in each of the two axially terminal portions of the passage for preventing insertion of a limb of a human adult or child to a depth sufficient to reach the screw without substantially impeding axial flow of water through the two terminal portions.

Other features, additional objects, and many of the attendant advantages of this invention will readily be appreciated from the following detailed description of a preferred embodiment when considered in connection with the appended drawing in which.

Figure 1:
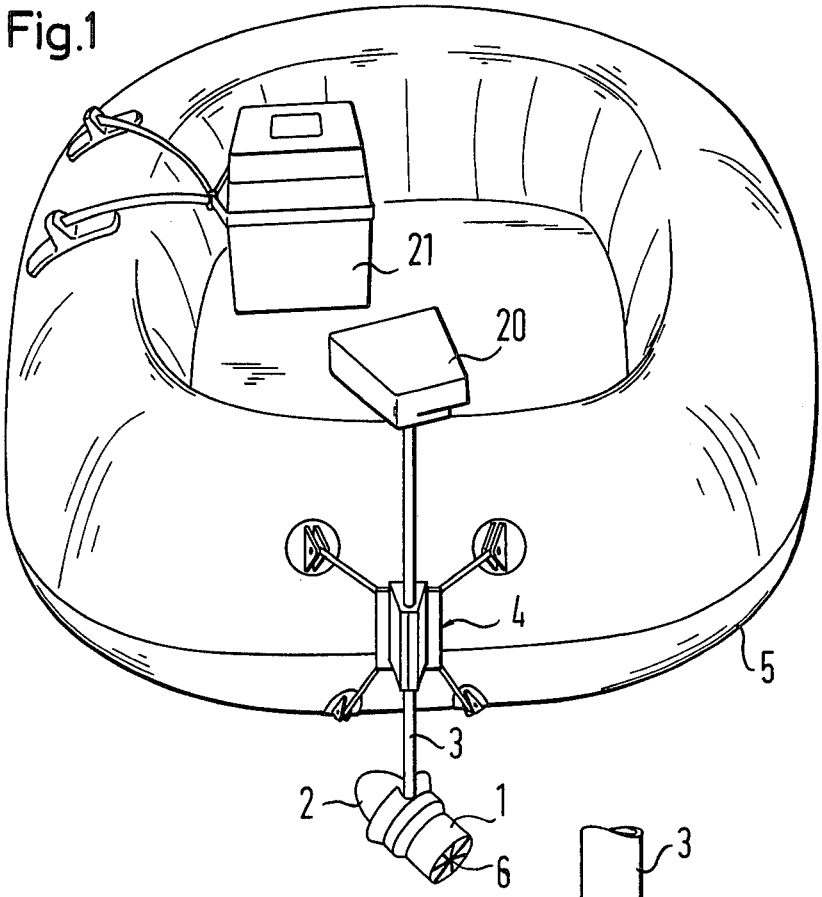
FIG. 1 shows a vessel equipped with the marine propulsion unit of the invention in a perspective view.

Referring now to the drawing in detail, there is shown an inflatable rubber dinghy 5 whose propulsion unit includes an electric motor 2 mounted on the hull of the dinghy 5 by means of a bracket 4 rotatably receiving a supporting rod 3. The lower end of the rod is attached to the motor 2, the upper end carries a tiller unit 20 including the controls for the motor 2, not specifically illustrated and conventional. The motor 2 is energized by a storage battery 21. The motor 2 is partly enclosed in a casing 1 of tapering, generally circular cross section. The motor axially projects from the open, wider end of the passage in the casing 1, and the narrow end of the casing passage is partly obstructed by seven baffle plates 6 whose narrow edges radiate equiangularly from the axis of the passage through the casing 1. The passage is much longer than wide, and sealed in a radial direction over most of its length. During normal movement of the dinghy 5, the wider end of the casing 1 is directed forward, and it will be referred to hereinafter as the front end of the casing and other spatial relationships will be identified correspondingly.

Figure 4:
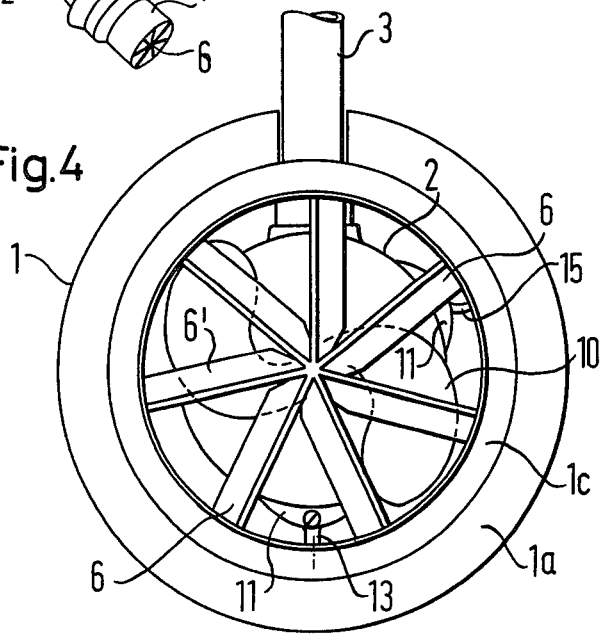
FIG. 4 is a rear elevation of the device of FIG. 3 on the same scale as FIG. 3.
Figure 2:
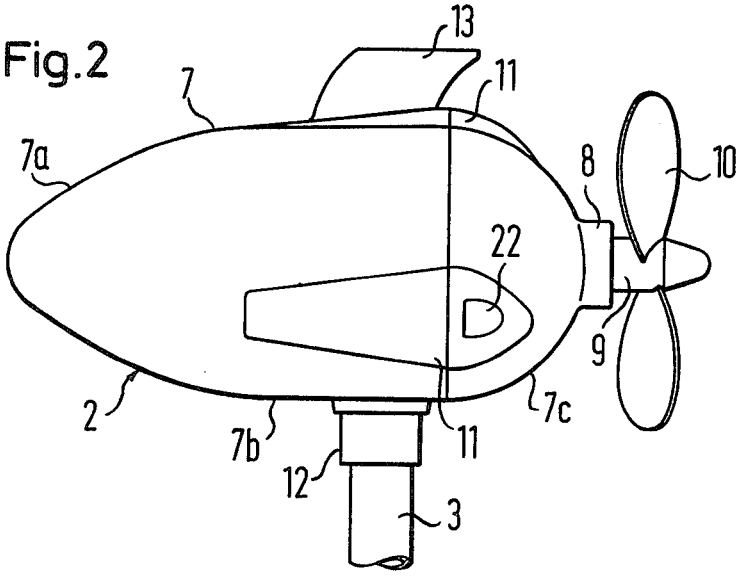
FIG. 2 illustrates the inverted drive motor and associated elements of the propulsion unit in side elevation.

As is shown in FIG. 2, the motor 2 has a torpedo-shaped housing 7 whose front portion **7*a* has the approximate shape of a cone with rounded apex. A substantially cylindrical middle portion 7*b* is integral with the front portion 7*a* and secured to a rear portion 7*c* which tapers approximately hemispherically to a cylindrical, coaxial bushing 8 from which the output shaft 9 of the motor projects. The shaft carries a propelling screw 10 having two blades. Respective axial parts of three ribs 11 on the housing portions 7*b*, 7*c* are fastened to each other by means of screws obscured in the view of FIG. 2 and accessible from the rear through recesses 22 in the rib parts on the housing portion 7*c*. A vane 13 radially projects from the housing portion 7*b* opposite the flange 12 which fastens the rod 3 to the housing 7. The free axial edge of the vane 13 is normally attached to the casing 1** as is shown in FIG. 4.

Figure 3:
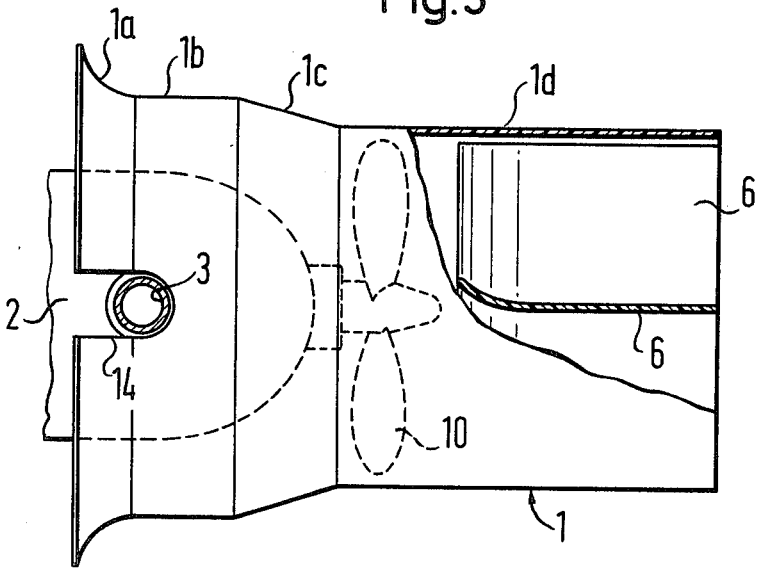
FIG. 3 shows the propulsion unit in side elevation, its casing being partly broken away to reveal internal structure, and the figure being drawn to scale.

The casing 1 is shown in more detail in FIG. 3. It consists of sheet material of uniform thickness and has a front end section **1*a* which is bell-shaped like the corresponding part of a trumpet and tapers to a first cylindrical section 1*b*. A conical casing section 1*c* tapers from the first cylindrical section 1*b* in a rearward direction to a long second cylindrical section 1*d* of smaller diameter than the section 1*b* which bounds the rear orifice of the casing. The motor 2 projects forwardly from the flaring orifice bounded by the front end section 1*a*, and the supporting rod 3 passes through a slot 14 extending inward from the casing orifice into the first cylindrical section 1*b***.

A major part of the tapering rear portion **7*c* of the motor housing 7 is spacedly enveloped by the casing section 1*c*, and the cylindrical housing part 7*b* axially extends over most of the first cylindrical casing section 1*b*. The screw 10 is located in the front orifice of the second cylindrical section 1*d*. Each baffle plate 6 extends along a plane through the casing axis from the rear orifice of the casing forward beyond the axial center of the second cylindrical section 1*d*. The front end 6' of each plate 6 is located closely adjacent the screw 10** and is bent obliquely in a direction opposite to the direction of screw rotation.

The diameters of the several casing sections are selected in such a manner that the effective flow section of the annular space in the first cylindrical casing section **1*b* is closely similar to or identical with the effective flow section of the second cylindrical casing section 1*d* behind the screw 10. The screw is axially centered between the orifices of the casing for best pusher action and for its protection. An odd number of baffle plates 6 is combined with the even-numbered blades of the screw 10** because the combination has been found to produce a more uniform propelling force than a combination of even numbers of screw blades with even numbers of baffle plates, or a combination of odd-numbered blades and plates, particularly when the screw is not fully immersed in water.

As is shown partly in FIG. 4, the casing 1 is additionally attached to the motor housing 7 by several brackets 15 of which only one is seen in the drawing. A cable connecting the motor 2 to the battery 21 passes through the hollow interior of the rod 3 to the tiller unit 20, and thence to the battery 21. It has not been shown since it is entirely conventional.

In an actual embodiment of the illustrated propulsion unit, the several portions and sections of the housing 7 and of the casing 1, and the baffle plates 6 had the dimensions, in millimeters, listed in the following Table. The measurements refer to external dimensions, but the thickness of the sheet material in the casing 1 is too small to matter.

TABLE

| | Axial length | Diameter |
|---|---|---|
| Wide orifice of casing 1 | — | 175 |
| Front end section 1a | 20 | — |
| 1st Cylindrical section 1b | 35 | 140 |
| Conical section 1c | 35 | — |
| 2nd Cylindrical section 1d | 130 | 120 |
| Housing front portion 7a | 80 | — |
| Middle portion 7b | 70 | 90 |
| Rear portion 7c | 45 | — |
| Baffle plates 6 | 90 | — |

The screw 10 thus was spaced from the two axial orifices of the casing 1 about 80–90 mm. Other dimensions of the preferred propulsion unit may be read from FIGS. 3 and 4 in the light of the dimensions listed in the Table.

Figure 5:
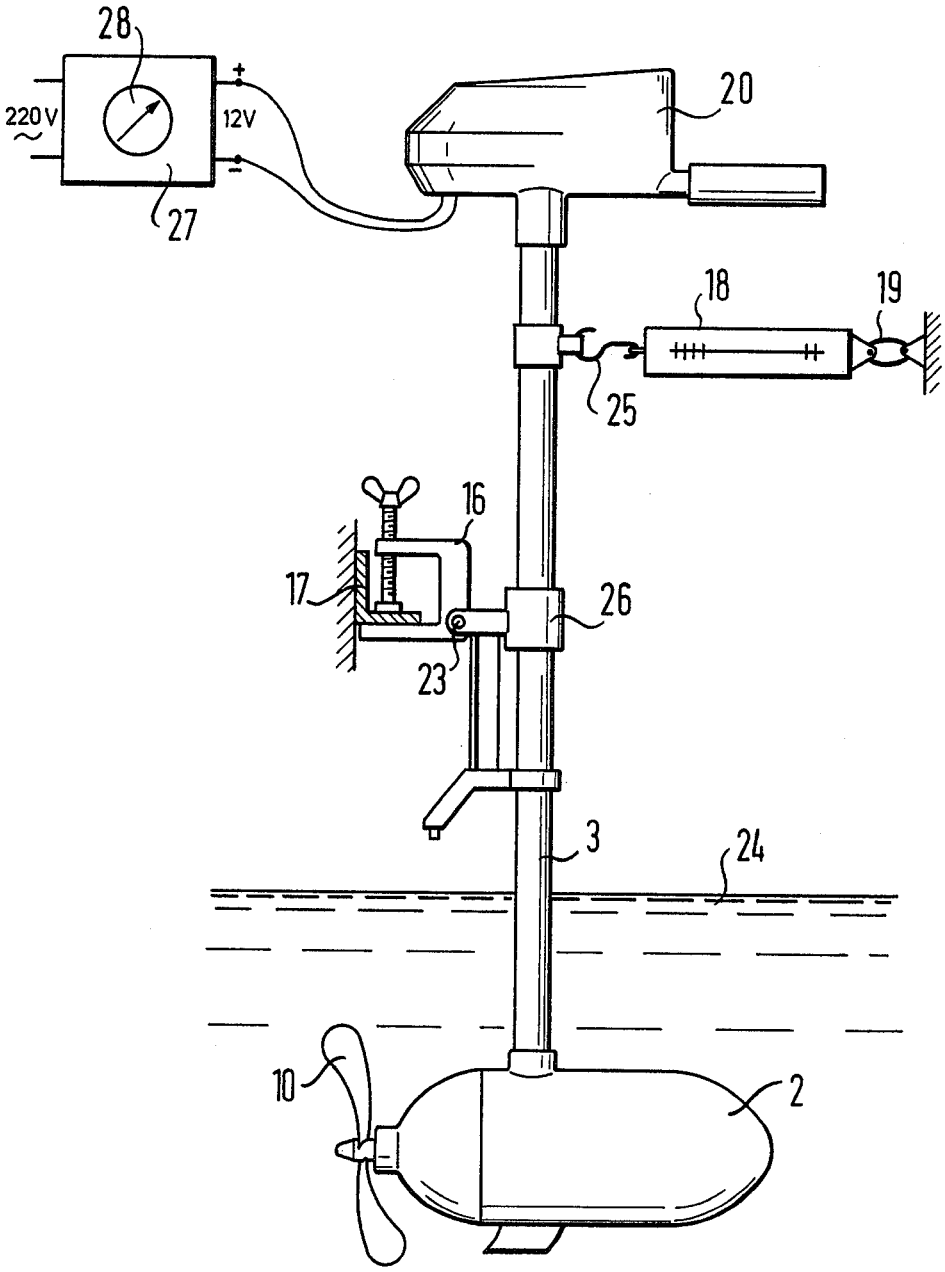
FIG. 5 illustrates a test stand carrying the propulsion unit without its casing, the view being in side elevation.

The effect of the casing 1 on the performance of the propulsion unit was determined in a simplified dynamometer arrangement illustrated in FIG. 5. The rod 3 was suspended from a rail 17 of a fixed frame by means of two clamps 16, 26 connected by a horizontal pivot pin 23. The motor 2 and its screw 10 were immersed to a precise depth in a body of water 24 contained in an elongated, rectangular tank (not shown) in such a manner that the screw 10 was directed longitudinally of the tank. A spring scale 18 was attached by a ring 19 to the fixed frame and by a hook 25 to an eye on the rod 3 approximately as far from the pivot pin 23 as the bottom end of the rod 3. Alternating line current at 220 volts was converted to direct current at 12 volts by a rectifier 27, and an amperemeter 28 indicated the current fed to the motor 2 through the tiller unit 20. The propelling force exerted by the screw 10 was read from the spring scale 18 in arbitrary, but reproducible units.

When the test was repeated with the casing 1 partly enclosing the motor 2 and screw 10 in the manner shown in FIGS. 1 to 4, the spring scale reading as well as the amperemeter reading was slightly lower. The ratio of the two readings, which is a measure of the efficiency of the propulsion unit, was the same in both tests. These results indicate that a propulsion unit lacking the casing 1 would propel a boat slightly faster under otherwise identical conditions than a propulsion unit equipped with the casing, but that a full charge of the same battery 21 would permit the boat to travel equally far in both cases.

In the illustrated embodiment of the invention, access to the screw 10 is obstructed in a forward direction by the motor housing 7 and in a rearward direction by the baffle plates 6 so that no injuries can be inflicted to a person by the rapidly rotating screw. The circumferential clearance between the plates 6 and the radial clearance between the housing 7 and the casing 1 are too small for accidental or intentional insertion of a human limb, such as the finger of an adult or the arm of a child, to a depth sufficient to reach the screw 10.

The safety features of the propulsion unit are available without loss of efficiency and with minimal loss of propelling power by suitably dimensioning the casing 1 and housing 7, the diameters of the middle portion **7*b*, the first cylindrical casing section 1*b*, and of the second cylindrical casing section 1*d* being related approximately as 9 : 14 : 12. It has further been found beneficial to make the diameter ratio of the front orifice of the casing 1 to the first cylindrical casing section 1*b* approximately 17.5 to 14, and to make the length ratio of the four casing sections 1*a*, 1*b*, 1*c*, 1*d* 2 : 3.5 : 3.5 : 13. The axial length of the baffle plates 6 should be related to the corresponding dimension of the second cylindrical casing section 1*d*** as 9 : 13. The dimensions listed in the Table satisfy these optimum relationships, but it has been found that they are to be maintained for equally favorable results when the propulsion unit is scaled up or reduced in size.

While the invention has been described with reference to an electrically energized outboard motor 2, it is equally applicable to outboard motors employing an internal combustion engine, and the prime mover of the propulsion unit need not be arranged within the protective casing 1, but may be arranged on a transom of the propelled vessel, and its power transmitted to the screw 10 in a conventional manner. A housing similar to the housing 7 may enclose the necessary angle drive and simultaneously obstruct access to the screw from the forward end of the casing 1. The problem of injury to humans by contact with a rotating ship's screw is equally serious with vessels employing an inboard engine, and the problem may be mitigated or solved by obvious modifications of the illustrated structure. ng ship's screw is equally serious with vessels employing an inboard engine, and the problem may be mitigated or solved by obvious modifications of the illustrated structure.

Plastics constitute the illustrated casing 1, housing 7, and baffle plates 6, but other materials of construction may be chosen according to their corrosion resistance and other necessary properties.

It should be understood, therefore, that the foregoing disclosure relates only to a preferred embodiment, and that it is intended to cover all changes and modifications of the example of the invention herein chosen for the purpose of the disclosure which do not depart from the spirit and scope of the appended claims.

What is claimed is:

1. A marine propulsion unit comprising:

(a) an elongated casing having an axis and formed with an elongated, axial passage therethrough,
  (1) said passage including four consecutive, axially joined sections of substantially circular cross section,
  (2) a first one of said sections being substantially bell-shaped and tapering toward the second section,
  (3) a third section tapering substantially conically from the second toward the fourth section,
  (4) the second and fourth sections being substantially cylindrical, said fourth section being smaller in diameter and axially longer than said second section;

(b) an approximately torpedo-shaped housing mounted in said passage, said housing being of substantially circular cross-section about said axis,
  (1) one axial end portion of said housing projecting outward of said casing through said first section,
  (2) the other axial end portion of said housing being spacedly enveloped by said third section and tapering in a direction toward said fourth section;

(c) drive means including a shaft substantially coaxially projecting from said other end portion toward said fourth section;

(d) a screw mounted on said shaft in said fourth section adjacent said third section for rotation by said drive means about said axis,
  (1) said housing and said casing radially defining therebetween an annular portion of said passage, said portion being of a length and width to prevent accidental insertion of a human limb into said passage through said first section to a depth sufficient to reach said screw;

(e) a plurality of baffle plates radiating from said axis in said fourth section and defining orifices of said passage therebetween, the spacing of said orifices from said screw being sufficiently great and the size of each orifice being sufficiently small to prevent accidental insertion of a human limb into said passage through said fourth section to a depth sufficient to reach said screw.

2. A unit as set forth in claim 1, wherein said first and fourth sections are the axially terminal portions of said passage.

3. A unit as set forth in claim 2, wherein said baffle plates are elongated axially in respective associated planes angularly intersecting each other in said axis, each baffle plate having a minor end portion axially adjacent said screw and obliquely offset from the associated plane, said casing radially sealing said passage in at least said third and fourth sections.

4. A unit as set forth in claim 2, wherein said screw has a first number of blades and said plurality of baffle plates consists of a second number of baffle plates, one of said numbers being even, and the other number being odd.

5. A unit as set forth in claim 4, wherein said first number is two, and said second number is seven.

6. A unit as set forth in claim 2, wherein a portion of said drive means is mounted in said housing.

7. A unit as set forth in claim 2, wherein said drive means include a motor enclosed in said housing.

8. A unit as set forth in claim 1, wherein said limb is the finger of an adult.

9. A unit as set forth in claim 1, wherein said limb is the arm of a child.

10. A unit as set forth in claim 1, wherein the effective flow section of said annular portion is defined by a portion of said housing intermediate said end portions thereof and of substantially cylindrical shape about said axis.

11. A unit as set forth in claim 10, wherein the effective flow section of said annular portion is closely similar to the effective flow section of said fourth section between said screw and said baffle plates.

* * * * *